US005251831A

United States Patent [19]

Yoshida et al.

[11] Patent Number: 5,251,831

[45] Date of Patent: Oct. 12, 1993

[54] ROLLER MILL

[75] Inventors: Hirohisa Yoshida; Tsugio Yamamoto; Masaaki Kinoshita; Hidenori Sakamoto, all of Nagasaki; Takeshi Kunimoto, Tokyo, all of Japan

[73] Assignee: Mitsubishi Jukogyo Kabushiki Kaisha, Tokyo, Japan

[21] Appl. No.: 823,361

[22] Filed: Jan. 21, 1992

[30] Foreign Application Priority Data

Jan. 21, 1991 [JP] Japan ..... 3-5330

[51] Int. Cl.[5] ..... B02C 23/08

[52] U.S. Cl. ..... 241/79.001; 241/80; 241/117; 209/139.001

[58] Field of Search ..... 241/79.1, 80, 117, 121, 241/186.2; 209/139.1, 139.2, 138

[56] References Cited

U.S. PATENT DOCUMENTS

| | | | |
|---|---|---|---|
| 1,702,248 | 2/1929 | Crites | 241/186.2 X |
| 4,235,385 | 11/1980 | Brundiek | 241/121 X |
| 4,260,478 | 4/1981 | Hosokawa et al. | 241/139.2 |
| 4,684,069 | 8/1987 | Hashimoto et al. | 241/80 X |
| 4,919,341 | 4/1990 | Lohnherr | 241/80 X |

FOREIGN PATENT DOCUMENTS

| | | |
|---|---|---|
| 0325770 | 8/1989 | European Pat. Off. . |
| 1938772 | 2/1971 | Fed. Rep. of Germany . |
| 3125850 | 4/1982 | Fed. Rep. of Germany . |
| 4002867 | 8/1991 | Fed. Rep. of Germany . |
| 1448417 | 6/1966 | France . |

*Primary Examiner*—Frank T. Yost
*Assistant Examiner*—Clark F. Dexter
*Attorney, Agent, or Firm*—Wenderoth, Lind & Ponack

[57] ABSTRACT

Raw coal is caused to fall through a coal feed pipe and onto a table so as to be pulverized by a roll. Fine coal particles and coarse coal particles resulting from pulverization are moved upward between an auxiliary classifier cone and a mill casing by hot air supplied from below the mill casing. The hot air (upward stream) carrying the fine coal particles and the coarse coal particles moves across a space of triangular cross section formed between the inverted conical body of the auxiliary classifier cone and the side wall of the mill casing and is forced through blowoff openings defined between deflector plates so as to flow as a lateral rotative stream toward a rotary classifier. Upon impinging the downward-inclined rotating vanes of the rotary classifier, the coarse coal particles are sprung back toward a lower portion of the auxiliary classifier cone and are separated from the fine coal particles. The fine coal particles separated from the coarse coal particles are ejected out of the roller mill together with the upward air stream through a pulverized-coal eject pipe. Coarse coal particles sprung back toward the lower portion of the auxiliary classifier cone move along the inner surface of the auxiliary classifier cone and fall onto the table so that they are re-pulverized by the roll.

8 Claims, 6 Drawing Sheets

ROLLER MILL

BACKGROUND OF THE INVENTION

1. Field of the Invention

This invention relates to a roller mill for pulverizing coal, for example, and feeding the pulverized coal to a boiler.

2. Description of the Prior Art

A conventional roller mill will be described with reference to FIGS. 7 through 11. In FIG. 7, reference numeral 13 designates an auxiliary classifier cone whose upper portion is made in a cylindrical shape and whose lower portion is made in an inverted truncated conical shape. In FIGS. 7 through 11, reference numeral 14 designates rotating vanes of a rotary classifier disposed inside the auxiliary classifier cone 13, and which are rotatably supported by a coal feed pipe 20. Reference numeral 15 designates a plurality of deflector plates, 16 a pulverized-coal eject section, and 18 a mill casing. An upper portion and a lower portion of each rotating vane 14 lie in the same vertical plane with respect to the direction of rotation, and the deflector plates 15 are attached to a cylindrical upper portion of the auxiliary classifier cone 13 and are spaced so that individual openings 17 are formed inbetween them. Reference numeral 21 designates a table disposed directly under the coal feed pipe 20, and 22 a roll.

In this roller mill, raw coal is caused to fall through the coal feed pipe 20 onto the table 21 so as to be pulverized by the roll 22, and fine coal particles and coarse coal particles resulting from pulverization are moved upward between the auxiliary classifier cone 13 and the mill casing 18 by means of hot air supplied from below the mill casing 18.

The hot air (upward stream) carrying fine coal particles and coarse coal particles moves across an annular passage formed between an upper portion of the mill casing 18 and the cylindrical upper portion of the auxiliary classifier cone 13, and flows through the openings 17 defined between the deflector plates 15 so as to become a lateral stream flowing toward the rotary classifier. Upon impinging the rotating vanes 14 of the rotary classifier (see FIG. 11), coarse coal particles 6 are sprung back toward the deflector plates 15 (see FIGS. 9 and 10) and are separated from fine coal particles 5; on the other hand, the fine coal particles 5 separated from coarse coal particles 6 are ejected together with the upward stream through the pulverized-coal eject section 16 out of the roller mill. The coarse coal particles 6 sprung back in toward the deflector plates 15 move along the inner surface of the auxiliary classifier cone 13 and fall on the table 21 so that they are repulverized by the roll 22.

The conventional roller mill as shown in FIGS. 7 through 11 has the following drawbacks.

(a) Since the coarse coal particles 6 impinging the rotating vanes 14 are sprung back in FIGS. 9 and 10, they are forced back by the air stream flowing through the openings 17 defined between the deflector plates 15 toward the rotary classifier, so that coarse coal particles 6 are mixed with the air stream carrying fine coal particles 5, resulting in a low efficiency of classification.

(b) Since the deflector plates 15 are attached to the cylindrical upper portion of the auxiliary classifier cone so that the openings 17 are formed between them, the annular passage must be provided around the circular array of openings 17. Thus, the upper portion of the casing 18 corresponding to the cylindrical upper portion of the auxiliary classifier cone 13 must be an enlarged portion, resulting in a correspondingly high cost. Contrarily, if the mill casing 18 were uniform in shape, the auxiliary classifier cone 13 and the rotary classifier 14 will have relatively small diameters and will produce a corresponding increase in the velocity of air flowing through them, resulting in a degradation in classification performance and an increase in pressure loss.

SUMMARY OF THE INVENTION

It is an object of the present invention to provide a roller mill which efficiently classifies coal, has low manufacturing costs and exhibits low pressure loss.

To accomplish the foregoing object, the present invention provides a classifier of a roller mill comprising a rotary classifier with a plurality of rotating vanes, and an auxiliary classifier cone surrounding the rotary classifier, wherein each rotating vane of the rotary classifier is designed such that its lower portion is trailing with respect to its upper portion in the direction of rotation so as to define a downward-inclined rotating vane, the auxiliary classifier cone has an inverted conical shape, the upper edge of the auxiliary classifier cone is attached directly to a mill casing, and a plurality of deflector plates are disposed in mutually spaced relation around an upper portion of the inverted conical body of the auxiliary classifier cone so that a stream moving upward on the outside of the auxiliary classifier cone will flow as a lateral rotative stream toward the rotary classifier in the vicinity of the upper portion of the auxiliary classifier cone.

In the roller mill of the present invention, therefore, raw coal falls through a coal feed pipe and onto a table so as to be pulverized by a roll, fine coal particles and coarse coal particles resulting from the pulverization are moved upward between the auxiliary classifier cone and the mill casing by means of hot air supplied from below the mill casing, the hot air (upward stream) carrying fine coal particles and coarse coal particles moves across a space of triangular cross section formed between the inverted conical body of the auxiliary classifier cone and the mill casing and is forced through blowoff openings defined between the deflector plates so as to flow as a lateral rotative stream toward the rotary classifier. Upon impinging the downward-inclined rotating vanes of the rotary classifier, coarse coal particles are sprung back toward a lower portion of the auxiliary classifier cone and are thus separated from fine coal particles. The fine coal particles separated from coarse coal particles are ejected together with the upward stream through a pulverized-coal eject pipe out of the roller mill. Coarse coal particles sprung back toward the lower portion of the auxiliary classifier cone move along the inner surface of the auxiliary classifier cone and fall onto the table so that they are repulverized by the roll.

DETAILED DESCRIPTION OF THE PREFERRED EMBODIMENT

Figure 1:
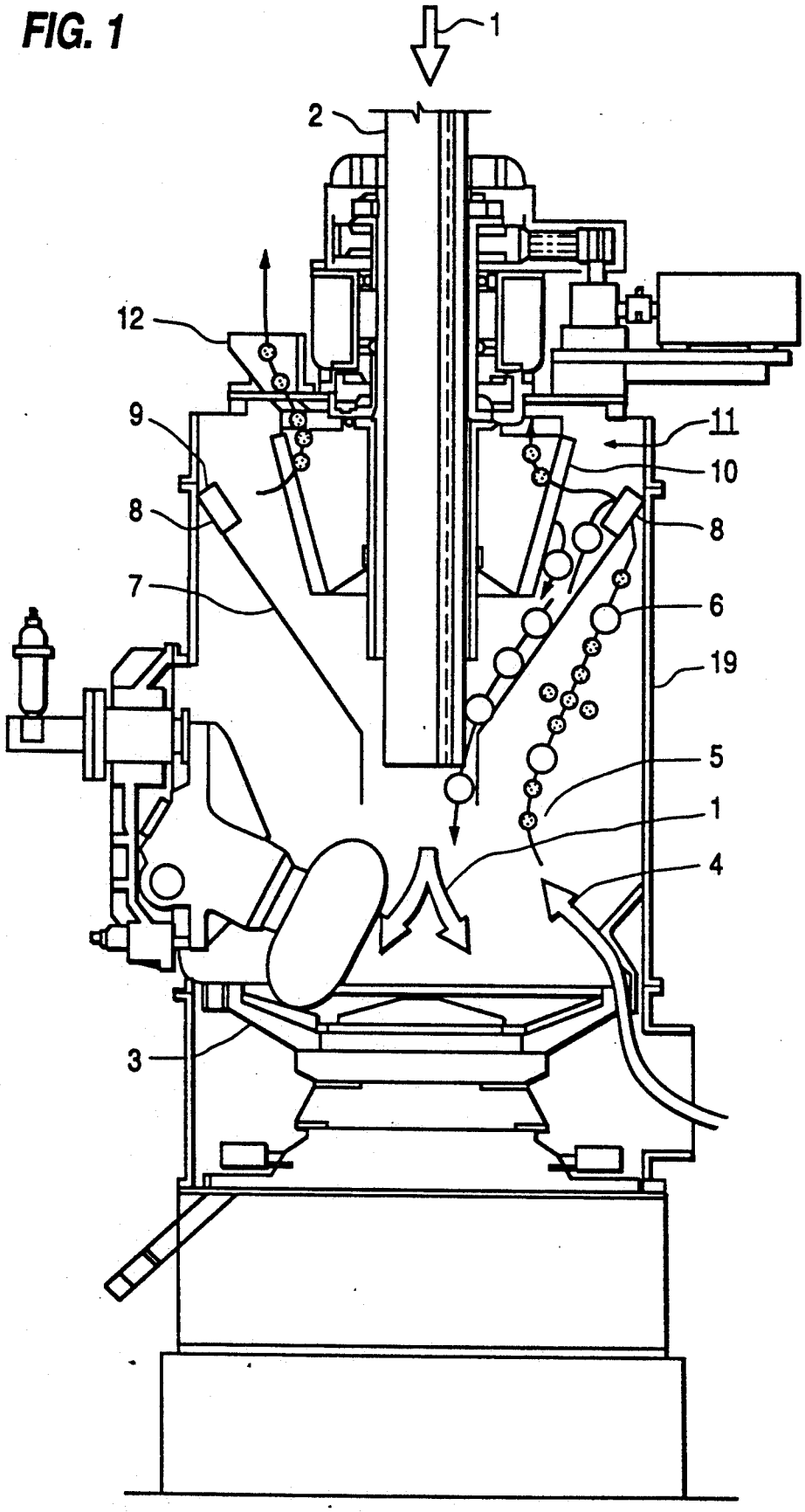
FIG. 1 is a schematic sectional view of a roller mill according to the present invention.
Figure 2:
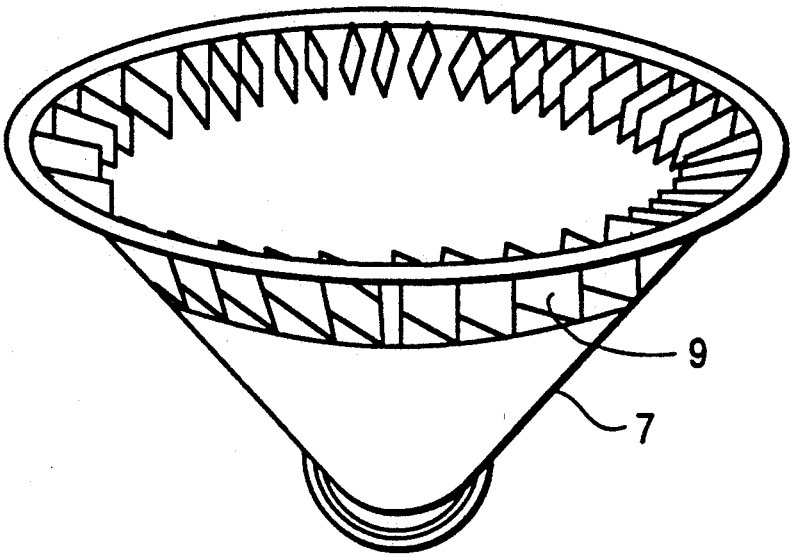
FIG. 2 is a perspective view of an auxiliary classifier cone of the present roller mill.
Figure 3:
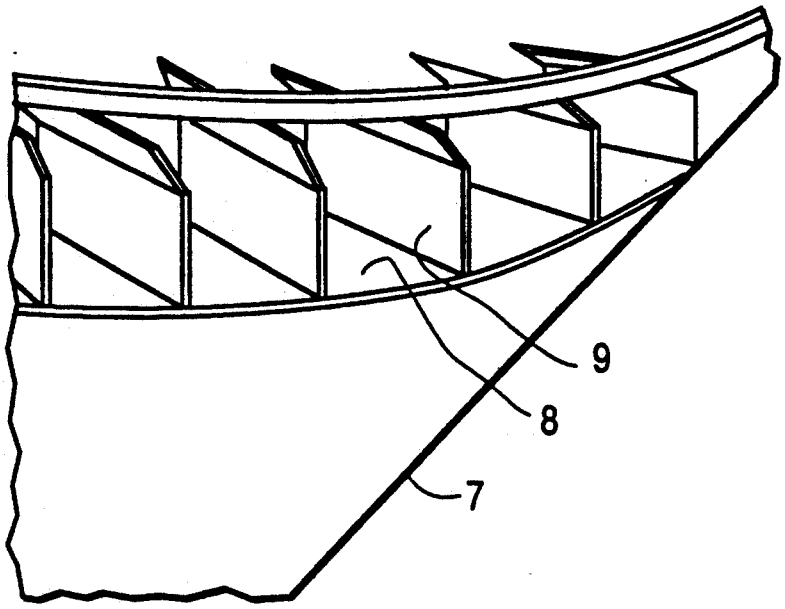
FIG. 3 is a perspective view of deflector plates provided in an upper portion of the present auxiliary classifier cone.
Figure 4:
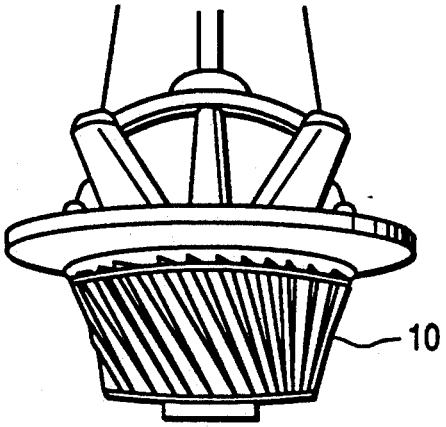
FIG. 4 is a perspective view of a rotary classifier of the present roller mill.
Figure 5:
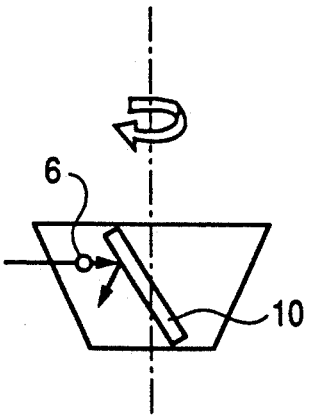
FIGS. 5 and 6 are schematic diagrams of a downward-inclined rotating vane of the present rotary classifier.
Figure 6:
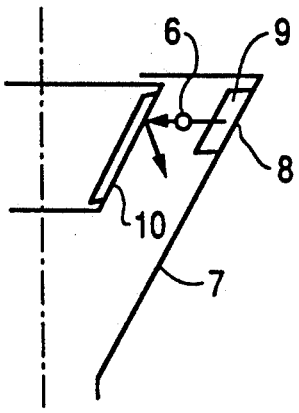
Figure 7:
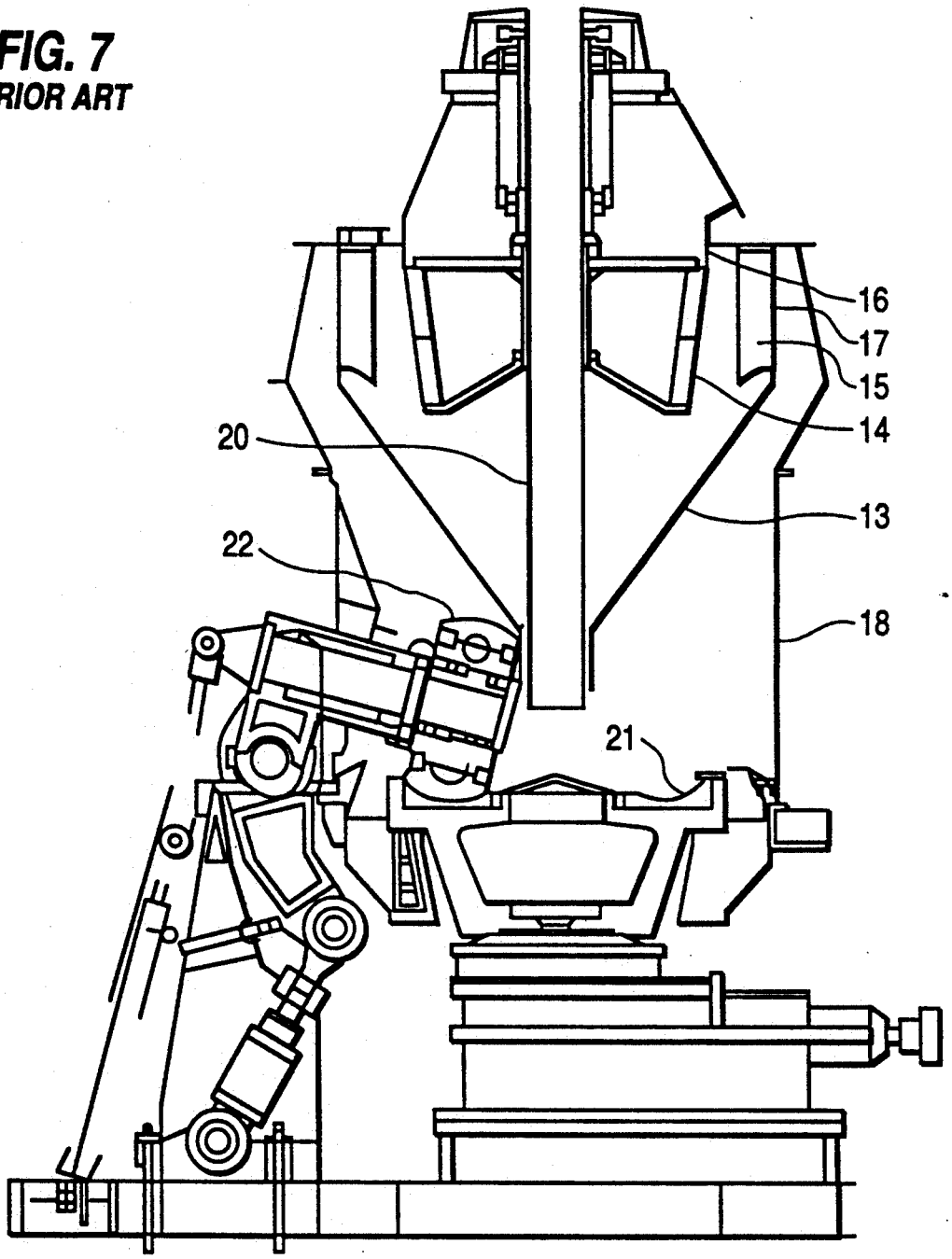
FIG. 7 PRIOR ART
FIG. 7 is a schematic sectional view of a conventional roller mill.
Figure 8:
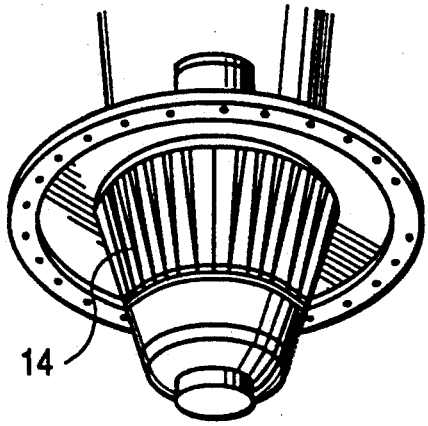
FIG. 8 PRIOR ART
FIG. 8 is a perspective view of a rotary classifier of the conventional roller mill.
Figure 9:
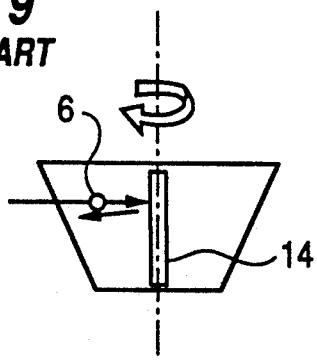
FIG. 9 PRIOR ART
FIGS. 9, 10 and 11 are schematic diagrams of a rotating vane of the conventional rotary classifier.
Figure 10:
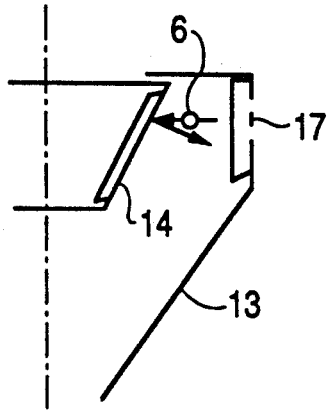
FIG. 10 PRIOR ART
Figure 11:
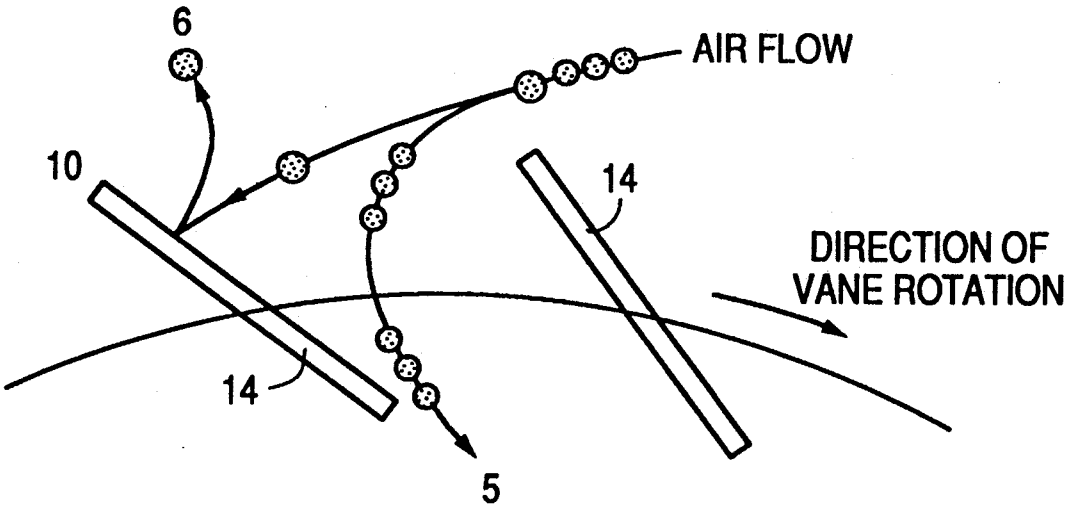
FIG. 11 PRIOR ART

A roller mill according to the present invention will now be described with reference to FIGS. 1 through 6. In these drawings, reference numeral 1 designates raw coal, 2 a coal feed pipe vertically disposed, 11 a rotary classifier, and 10 rotating vanes of the rotary classifier, which are rotatable about the coal feed pipe 2 clockwise as viewed from above as illustrated by the arrow in FIG. 5. As shown in FIG. 5, each rotating vane 10 is designed such that its lower portion is trailing with respect to its upper portion in the direction of rotating, thereby defining a downward-inclined rotating vane.

Reference numeral 3 designates a table, 4 hot air, 5 fine coal particles, 6 coarse coal particles, 7 an auxiliary classifier cone having an inverted generally conical shape and which is disposed above the table 3, and 19 the side wall of a mill casing which is generally formed as a right cylinder. The upper edge of the inverted conical body of the auxiliary classifier cone 7 is attached to the side wall 19 of the mill casing so that a space of triangular cross section is formed between the auxiliary classifier cone 7 and the mill casing at the side wall 19 thereof.

In FIGS. 1 and 3 through 6, reference numeral 8 designates a plurality of blowoff openings formed in an upper peripheral portion of the auxiliary classifier cone 7 as to open obliquely downward into the space of triangular cross section. Reference numeral 9 designates a plurality of deflector plates attached to the inner surface of the upper peripheral portion of the auxiliary classifier cone 7 in a mutually spaced relation so as to define the blowoff openings 8 therebetween. The combination of blowoff openings 8 and deflector plates 9 acts to change an upward stream moving upward on the outside of the auxiliary classifier cone 7 to a lateral rotative stream flowing toward the rotary classifier 11 in the vicinity of the upper edge of the auxiliary classifier cone 7. Reference numeral 12 designates a pulverized-coal ejection pipe provided at the top wall of the mill casing in confronting relation to the upper end of the rotary classifier 11.

The operation of the roller mill shown in FIGS. 1 through 6 will be described. The raw coal 1 is caused to fall through the coal feed pipe 2 onto the table 3 so that it is pulverized by a roll, and fine coal particles 5 and coarse coal particles 6 resulting from pulverization are moved upward between the auxiliary classifier cone 7 and the side wall 19 of the mill casing by means of the hot air 4 supplied from below the mill casing.

The hot air (upward stream) carrying fine coal particles 5 and coarse coal particles 6 moves across the space of triangular cross section formed between the auxiliary classifier cone 7 and the side wall 19 of the mill casing and flows through the blowoff openings 8 defined between the deflector plates 9, so that the upward stream then flows as a lateral rotative stream toward the rotary classifier 11. Upon impinging the downward-inclined rotating vanes 10 of the rotary classifier 11 (see FIGS. 5 and 6), coarse coal particles 6 are sprung back toward a lower portion of the auxiliary classifier cone 7 and are separated from fine coal particles 5; on the other hand, fine coal particles 5 separated from coarse coal particles 6 are ejected together with the upward stream through the pulverized-coal ejection pipe 12 out of the roller mill.

Coarse coal particles 6 sprung back toward the lower portion of the auxiliary classifier cone 7 as described above move along the inner surface of the auxiliary classifier cone 7 and fall onto the table 3 so that they are re-pulverized by the roll.

Table 1 lists the results of tests performed on a roller mill including the rotary classifier of the present invention and a similar mill including the conventional classifier. As will be appreciated, for substantially the same pass amount relating to 200 mesh, the present invention provides only a very small residual amount relating to 100 mesh (corresponding to coarse coal particles) and needs only as slow a speed as about 40 rpm for rotation of the classifier. And, the mill pressure loss is as low as 20 to 50 $mmH_2O$. That is, the listed results of tests will prove that the rotary classifier of the present invention has a high degree of classification performance.

TABLE 1

| | roll mill with present classifier | | | roll mill with conventional classifier | | |
|---|---|---|---|---|---|---|
| test run | 1-1 | 1-2 | 1-3 | 2-1 | 2-2 | 2-3 |
| classifier speed (rpm) | 75 | 100 | 125 | 110 | 140 | 170 |
| 200-mesh pass amount (%) | 76 | 88 | 99 | 75 | 87 | 99 |
| 100-mesh residual amount (%) | 2.1 | 0.1 | 0.0 | 3.9 | 1.2 | 0.2 |
| mill pressure loss ($mmH_2O$) | 310 | 328 | 356 | 332 | 367 | 405 |

As described above, in the roller mill of the present invention, raw coal is caused to fall through the coal feed pipe onto the table so as to be pulverized by the roll. Fine coal particles and coarse coal particles resulting from pulverization are moved upward between the auxiliary classifier cone and the side wall of the mill casing by means of hot air supplied from below the mill casing. The hot air (upward stream) carrying fine coal particles and coarse coal particles moves across the space of triangular cross section formed between the inverted conical body of the auxiliary classifier cone and the mill casing and is forced through the blowoff openings defined between the deflector plates so as to flow as a lateral rotative stream toward the rotary classifier. Upon impinging the downward-inclined rotating vanes of the rotary classifier, coarse coal particles are sprung back toward a lower portion of the auxiliary classifier cone so that they are separated from fine coal particles. Therefore, coarse coal particles are prevented from mixing with fine coal particles, the air stream entraining the fine coal particles (which is ejected through the pulverized-coal eject pipe) carries substantially no coarse coal particles, and thus, the efficiency of classification is enhanced.

Since coarse coal particles are sprung back toward the lower portion of the auxiliary classifier cone, the air stream flowing through the openings defined between the deflector plates toward the rotary classifier is not disturbed; thus, the pressure loss can be decreased.

Further, the auxiliary classifier cone has an inverted conical shape as viewed from its lower edge to its upper edge, the upper edge of the cone is attached directly to the side wall of the mill casing, and the deflector plates are arranged in a mutually spaced relation around the upper portion of the inverted conical body of the auxiliary classifier cone so that the upward stream moving along the outside of the auxiliary classifier cone is forced to flow as a lateral rotative stream toward the rotary classifier in the vicinity of the upper end of the auxiliary classifier. Because the upper portion of the auxiliary classifier cone is not cylindrical as in the prior art, the auxiliary classifier cone can be more compact and thus less costly to manufacture.

What is claimed is:

1. Classifier structure of a roller mill, said structure comprising: a mill casing including a vertically extending side wall and a top wall disposed over said side wall, the side wall of said mill casing having the shape of a right cylinder, a rotary classifier disposed within said mill casing, and an auxiliary classifier extending around said rotary classifier in the mill casing, said rotary classifier having a plurality of vanes and supported in the mill for rotation about a vertical axis in a rotary direction, each of said vanes being inclined relative to said vertical axis in said rotary direction and having an upper portion and a lower portion disposed such that the lower portion trails the upper portion when rotated in said rotary direction, and said auxiliary classifier including an auxiliary classifier cone including an upper portion having an inverted conic shape and terminating at an upper edge forming the periphery of the base of the conic shape thereof, and a plurality of deflector plates disposed in a spaced relation of said upper edge and around the entirety of the upper edge of said upper portion, a lower cylindrical portion extending from a lower end of said upper portion, and a ring attached to said deflector plates and extending in a horizontal plane between and securing said deflector plates and said side wall of the casing, said auxiliary classifier cone being attached direction to the side wall of said mill casing at said ring, and said auxiliary classifier cone defining a plurality of openings therethrough between said spaced deflector plates, whereby a stream forced upwardly between the auxiliary classifier cone and the side wall of said wall casing will flow through said plurality of openings and toward said rotary classifier in the vicinity of the upper edge of the upper portion of said auxiliary classifier cone.

2. Classifier structure as claimed in claim 1, and further comprising a coal feed pipe extending vertically through the top wall of said mill casing, and wherein said rotary classifier is supported for rotation about said coal feed pipe.

3. Classifier structure as claimed in claim 2, and further comprising a pulverized-coal ejection pipe provided at the top wall of said mill casing, an end of said ejection pipe opening to the interior of said mill casing and confronting an upper end of said rotary classifier.

4. Classifier structure as claimed in claim 3, wherein the sidewall of said mill casing has the shape of a right circular cylinder.

5. Classifier structure as claimed in claim 2, wherein the side wall of said mill casing has the shape of a right circular cylinder.

6. Classifier structure as claimed in claim 1, and further comprising a pulverized-coal ejection pipe provided at the top wall of said mill casing, an end of said ejection pipe opening to the interior of said mill casing and confronting an upper end of said rotary classifier.

7. Classifier structure as claimed in claim 6, wherein the sidewall of said mill casing has the shape of a right circular cylinder.

8. Classifier structure as claimed in claim 1, wherein the side wall of said mill casing has the shape of a right circular cylinder.

* * * * *